US005718068A

United States Patent [19]

Sawyer et al.

[11] Patent Number: 5,718,068

[45] Date of Patent: Feb. 17, 1998

[54] SNOWSHOE FRAME WITH FLEXIBLE REAR SECTION

[76] Inventors: Ryan Sawyer; Richard B. Sawyer, both of 7410 S. Dahlia Ct, Littleton, Colo. 80122

[21] Appl. No.: 732,190

[22] Filed: Oct. 17, 1996

[51] Int. Cl.[6] ..... A43B 5/04

[52] U.S. Cl. ..... 36/122; 36/123

[58] Field of Search ..... 36/122–125

[56] References Cited

U.S. PATENT DOCUMENTS

| | | | |
|---|---|---|---|
| 4,203,236 | 5/1980 | Erickson et al. | 36/124 |
| 4,228,601 | 10/1980 | Lawton et al. | 36/124 |
| 4,720,927 | 1/1988 | Abegg | 36/122 |
| 5,459,950 | 10/1995 | Damm et al. | 36/123 X |

FOREIGN PATENT DOCUMENTS

| | | | |
|---|---|---|---|
| 906522 | 8/1972 | Canada | 36/123 |
| 2409066 | 7/1979 | France | 36/124 |

OTHER PUBLICATIONS

Atlas Snowshoe; HTTP:WWW.atlasworld.com /file: Atlas.PDF Jun. 6, 1996.

*Primary Examiner*—Ted Kavanaugh

[57] ABSTRACT

An improved snowshoe frame design comprised of two "U" shaped segments, a front segment and a rear segment, in which the rear segment is pivotally attached to the front segment producing an axis of rotation perpendicular to the major axis of the frame plane. The two said joints permit adjustable spring-damper characteristics whereas the stable position is such that the major axis of the two segments is collinear. Both segments containing two optional cross members for the purpose of aiding in rotational integrity of the said joint, one on each "U" segment, parallel to axis of rotation of said segments. The cross member of said front segment optionally includes a plate welded, or attached by other mechanical means, vertically and parallel to the axis of said member, on the snowside of the segment. Two slidable tubes over the outer diameter of front and/or rear segment near the two joints, with a latching means, to allow a locking feature of said joints at the described stable position. The purpose of the improved snowshoe frame design is to increase handling of snowshoes down inclines of moderate to hard packed snow, and to allow natural walking patterns on moderate to hard packed snow, where the effective snowshoe surface area can be minimized.

1 Claim, 7 Drawing Sheets

SNOWSHOE FRAME WITH FLEXIBLE REAR SECTION

FIELD OF THE INVENTION

This invention relates to winter outdoor gear, and more particularly to showshoes.

BACKGROUND OF THE INVENTION

Snowshoes allow people to travel across snow fields of variable consistency, including powder snow to hard packed snow. The idea behind the snowshoe is to decrease the pressure (force/surface area ratio) that the user exerts onto the contacted surface of the snow. The less pressure the user exerts onto the snow, the less he or she will sink into the snow, making it easier for the user to traverse the snowfield. Since the weight of the user is constant, the only way to reduce the pressure on the surface is by increasing the contact surface area between the user and the snow, hence the reason for the conventional snowshoes long flat design. Although the large surface area of the snowshoe is greatly needed when traveling in snow with powdery consistency, there are some instances where the full area of the snowshoe is not needed and even counterproductive.

An example of when the user does not need the full surface area to traverse is when the snow is flat and hard packed. In this case the user does not need the extra surface area to traverse the field, but the user must deal with the disadvantages of having the snowshoe attached to his/her feet. Since the rear section of the snowshoe extends well past the user's heel, the user must walk with his/her feet flat. In this situation most users would prefer placing heel first then pivoting on a fulcrum created by their heel in contact with the surface. If a snowshoe could accommodate such a motion user efficiency would greatly improve across hard packed surfaces.

Another problem with existing snowshoe designs is the inadequate traction they provide when traversing down inclines of moderate to hard packed snow. The problem in this situation is the user's inability to use the heel of the foot as the initial stage in a step. While a user traverses down the described incline, he/she must point the foot downhill when taking a step. Whether the user will slide or not depends on the frictional forces created by the underside of the snowshoe. On the other hand, if the user could create a "step" in the snow by using the heel of his/her foot, friction becomes less of an issue. The user is now stabilized by the cohesion of the snow below his/her feet which, in packed snow, is generally strong enough to stabilize the user on fairly steep inclines.

Prior art for snowshoe designs do not allow the user to use the heel of the foot as the initial stage in the stepping motion. Very little effort has been put forth in prior art to allow such a motion. The snowshoe design in Pat. No. 4,720,927 to Abegg does claim "a snowshoe having a flexible framework . . . " but the flex does not permit "heel first" strides. A new snowshoe frame design that could give the user the option between a flexible and rigid rear section would greatly improve the user efficiency in traversing snowfields of moderate to hard packed snow.

OBJECTS AND ADVANTAGES

The presented invention is a snowshoe frame design comprised of two "U" shaped segments: a front segment and a rear segment, in which the rear segment is pivotally attached to the front segment producing an axis of rotation perpendicular to the major axis of the frame plane. The preferred embodiment includes an additional member to both segments, near and parallel to the axis of rotation to retain the "U" shape of both segments. The axis of rotation of the joints is located just behind the relative positioning of the user's heel to the snowshoe frame embodiment. These flexible joints create a contact edge just behind the users heel when the user steps onto the snow with heel first. When the user travels down an incline of packed snow this edge cuts through the surface of the snow and creates a "step" in the snow, aiding in downhill propagation. When the user travels across flat packed snow, the edge simply makes propagation easier by allowing a more natural stride. Prior art for snowshoe frame design does not permit frame deformation such as the present invention described.

The two joints of the present invention are made to permit rotational spring-damper characteristics whereas the stable position is such that the major axis of the two segments is collinear. When the user is applying little or no force onto the rear segment it is necessary that the normal position of the rear segment is that of a single segment frame, so that the rear segment is not bound underneath the front segment or resting onto the heel of the users foot. The spring-damper characteristics of the joints is achieved by mechanically securing the ends of two solid cylindrical elastomers, or another material with spring-damper characteristics similar to that of an elastomer, into the four open ends of both front and rear segments. The finished joints will allow approximately 0.25" to 4" of a gap between the ends of both segments allowing rotational motion of the rear segment in relation to the axis created by the two said joints. When the user applies pressure to the rear segment rotational motion is permitted but when the user takes pressure off of the snowshoe the rear segment will return back to the normal position.

The preferred embodiment will also contain helical springs around the parameter of the visible portion of the elastomers to increase the strength of the said joints. The use of springs in the present invention allows for a wide range of torsional strengths at the joints, dependent on the spring constant of the springs chosen by the manufacturer or user. As a result, the user can calibrate his/her snowshoe frame to their weight, skill level, or other such variables which would effect the performance of the snowshoes.

The present invention also contains two hollow sleeves of material matching that of the frame segments. The sleeves are sized to slide over the outer diameter of the frame segments, and thick enough to prevent bending. The two sleeves are normally located over the gap between the front segment and the rear segment such that both said joints are covered by the sleeves. With the sleeves in this normal position the two said joints are locked so that the major axis of the front and rear segments are collinear. With the sleeves in this normal position the snowshoe behaves similar to that of the conventional snowshoe. The secondary position of these sleeves is such that both sleeves inner diameters encompasses only the ends of the rear segment. With the sleeves in this secondary position, rotation at the said joint is permitted as described. For propagating across fields of power snow, the user can place both sleeves in the normal position allowing the maximum effectiveness of the snowshoe. For propagating across or down fields of packed snow, the user can place both sleeves in the secondary position allowing "heel first" strides.

In conclusion, the prior art for snowshoe designs do not allow users to make "heel first" strides when propagating across or down fields of packed snow. In order to make snowshoeing more efficient, there is need for a snowshoe frame which would accommodate the users desire to step with the heel of the foot. The present invention accommodates this need. Further objects and advantages of the present invention will become apparent from a consideration of the drawings and ensuing description.

SUMMARY

The present invention is a snowshoe frame which allows deflection in the rear section when it is otherwise locked.

DETAILED DESCRIPTION OF THE PREFERRED EMBODIMENTS

Figure 1A:
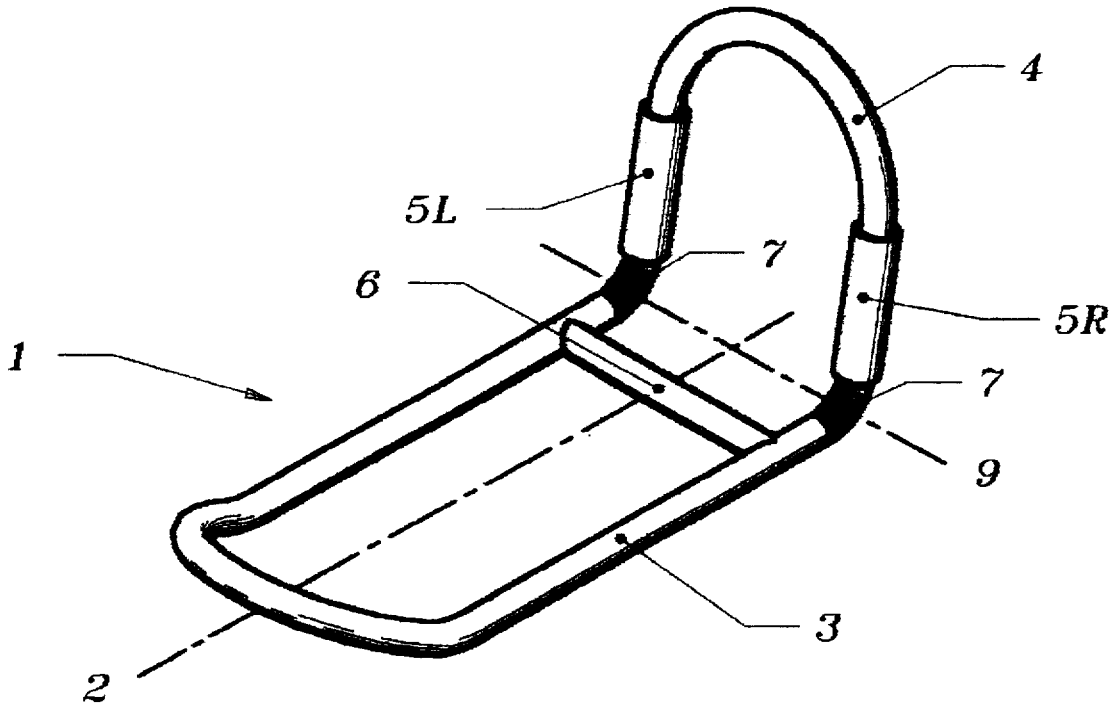
FIG. 1A and 1B is a breakaway, perspective view of a snowshoe frame, according to the embodiment of the present invention.
Figure 1B:
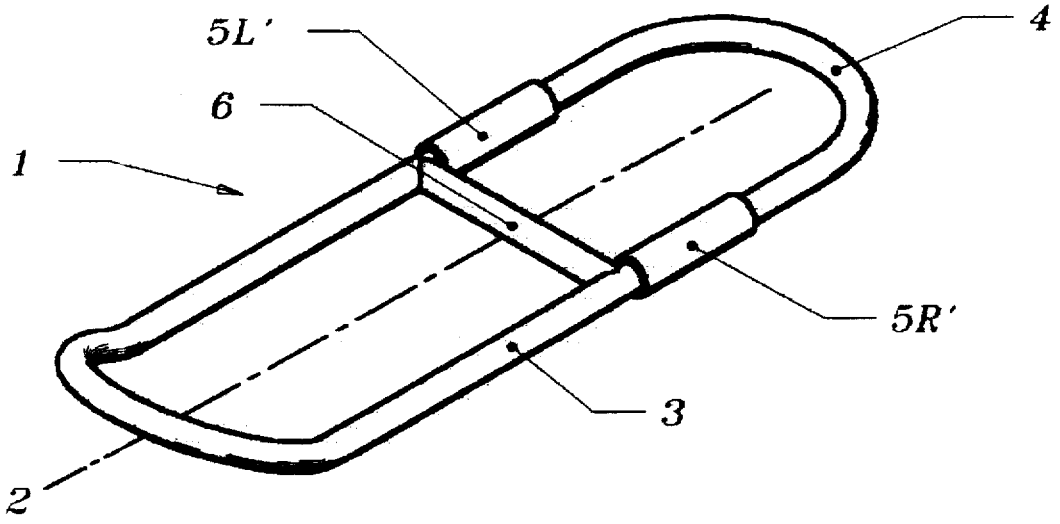
Figure 2A:
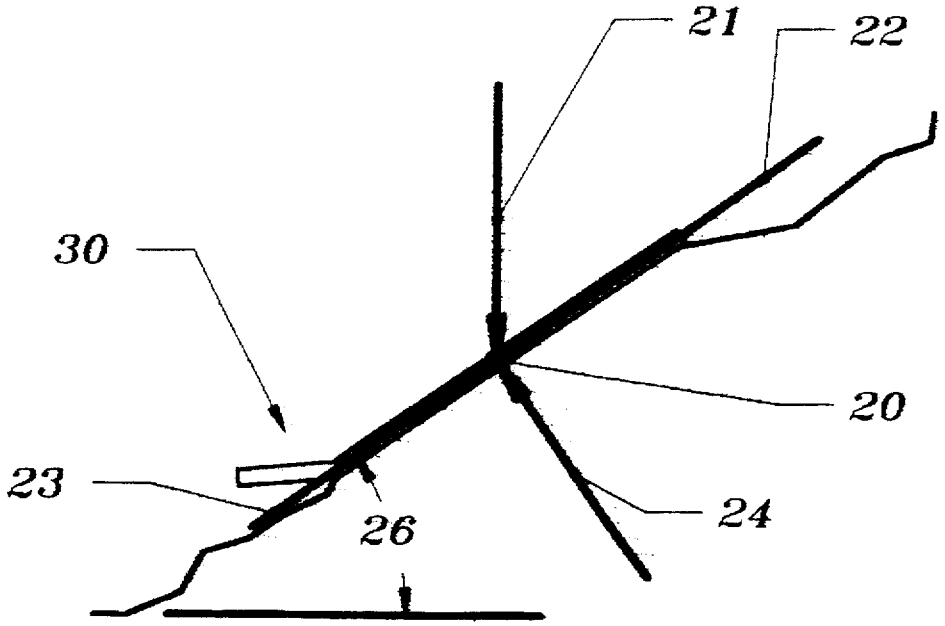
FIG. 2A (PRIOR ART)
FIG. 2A and 2B are free body diagrams demonstrating the stability of the snowshoe frame, according to the present invention.
Figure 2B:
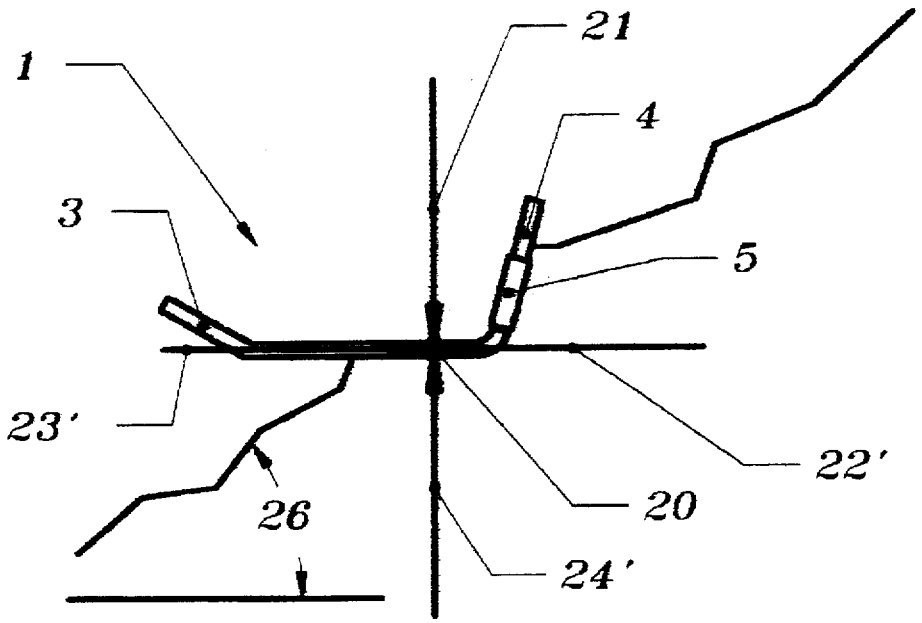
Figure 3:
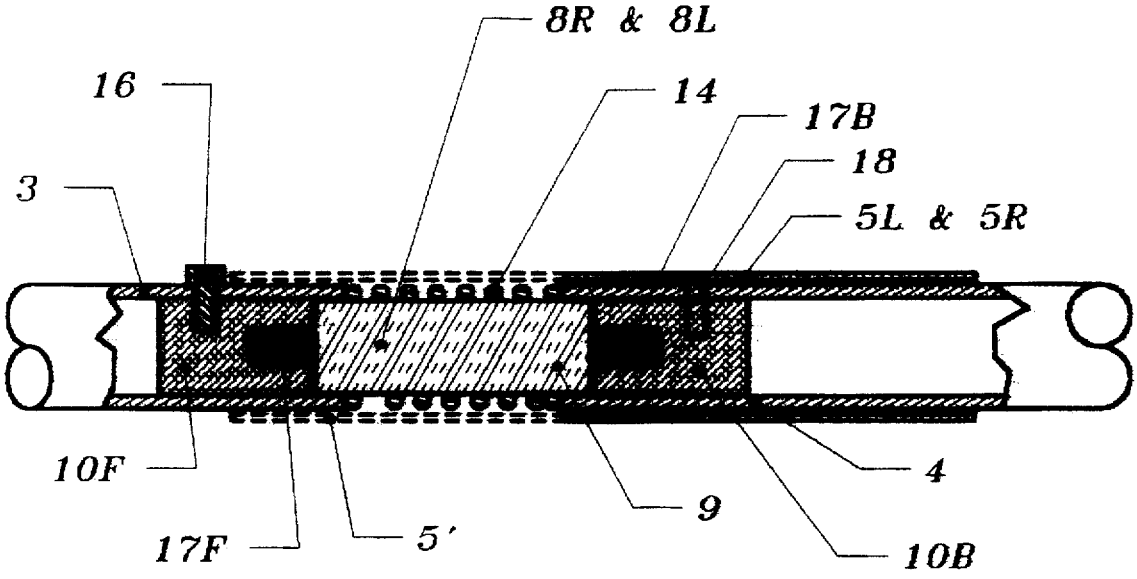
FIG. 3 is a cross sectional view of a joint embodiment, according to the present invention.

The present invention is referred to in FIG. 1A and FIG. 1B as numeral 1. The snowshoe frame (1) generally consists of front "U" shaped section (3), rear "U" shaped section (4), two flexible joints (7) joining front (3) and rear segments (4), two sliding sleeve's (5), and crossmember (6). FIG. 1B shows sleeve's (5') in the primary position, while FIG. 1A shows sleeve's (5) in the secondary position.

Front segment (3) is formed from hollow tubing made of a light weight, structurally stable material such as aluminum, titanium, or other materials such as carbon fiber. In the preferred embodiment, the approximate outer diameter of the tubing is ⅞" and the inner diameter is approximately ¾". Two parallel sides of the front segment (3) are roughly 2" to 6" plus the average width of a human foot apart. The rounded end of front segment (3) is bent upward such that the plane of the rounded end is approximately 25 to 45 degrees different from the plane created by the two straight segment. The overall length of front segment (3), from rounded end to open end, can vary dependent on the desired use of snowshoe frame (1). For example a longer length of about 30" would be the desired dimension for taller user, while a shorter user may only require a length of about 20". The nominal size of front segment (3) is 22" long by 8" wide.

Rear section (4) is formed of the same material of said front segment (3), and equal in width to that of said front segment (3). The overall length of rear section (4), from rounded end to open end, can vary dependent on the desired use of snowshoe frame (1), although not to vary drastically from a nominal length of 10".

In order to maintain dimensional characteristics front segment (3) a crossmember(6) made from the same material as said front segment (3), is mechanically attached, preferably by TIG weld, to the insides of the two open ends of front segment (3). The positioning of crossmember(6) is such that the longitudinal axis of crossmember(6) is perpendicular to both parallel sides of front segment (3).

Two locking sleeves (5L and 5R) made from similar material as said front segment (3) are positioned over the two open ends of said rear segment (4), whereas the inner diameter of the tubing is close to or slightly larger than the outer diameter of said front segment (3). In the preferred embodiment locking sleeves (5L and 5R) are made from thin walled anodized aluminum tubing with a knurled outer parameter for manipulation purposes. The length of locking sleeves (5L and 5R) is approximately 3" to 7" where the preferred length is 4.5".

The preferred embodiment contains two rear stud cylinders (10B) formed of the same material as said front segment (3). A stud cylinder is drilled and internally threaded through the cylindrical axis with a thread pitch diameter larger than 0.12" and a thread pitch larger than 12 threads/inch and deeper than 0.1". The preferred embodiment for rear stud cylinder (10B) implies a ¼"×28 internal thread on the flexible cylinder studd (17B) should be used. The outer diameter of said rear stud cylinder (10B) is equal or smaller than the inner diameter of the rear section (4) embodiment. Both rear stud cylinders (10B) are positioned into the open ends of rear section (4) with the threaded end facing outward and mechanically attached, preferably by TIG weld or by a pin passing through the material of rear section (4) into rear stud cylinder (10B). The face of the threaded end of rear stud cylinder (10B) is positioned flush or intruded from the end of said rear segment (4), but it is conceivable an alternative embodiment may require the said face to be protruded from said rear segment (4) end.

The preferred embodiment contains two front stud cylinder (10F) formed of the same material as said rear stud cylinders (10B). Said front stud cylinders (10F) are drilled and tapped similar to that of the said rear stud cylinders (10B). The two said front stud cylinders (10F) are positioned in front segment (3) as rear stud cylinders (10B) are positioned in said rear segment (4). Although there are several means for attaching said rear stud cylinders (10B) into said front segment(3) the preferred embodiment would contain a externally threaded bolt with a knurled head(16), passing through the said front segment (3) and attaching into said front stud cylinder (10F). The functionality of knurled bolt(16) will be discussed further on.

Two flexible cylinders (8) made from a solid core elastomer or a material with similar elastic and strength characteristics as elastomers is used to join the said front segment with the said rear segment. A reasonable elastomer to use would be neoprene rubber. The outer diameter of a flexible cylinder (8) is nearly equal to the inner diameter of the tubing material of said front segment (3). In the preferred embodiment, two studs (17B & 17F) are imbedded into the body of a flexible cylinder so that a single stud (17B or 17F) is perpendicular to the flat face of the Flexible cylinder and colinear with the major axis of flexible cylinder (8). Each stud protrudes approximately 0.25"–1" from flexible cylinder (8) embodiment with external threads corresponding to the thread pitch and diameter of said rear stud cylinders (10B). Flexible cylinder (8) embodiment as described is commonly available and sold as motor vibration dampeners. The preferred embodiment utilizes these existing motor dampeners, but an alternate embodiment may require a design more suited for handling bending loads.

In the preferred embodiment both Rear studs (17B) from flexible cylinder (8) embodiment are screwed firmly into both female threads of said rear stud cylinders (10B). Before said front stud cylinders (10F) are locked into position with said knurled bolt (16) they are firmly screwed onto two front studs (17F). At this point two joint springs (14) are chosen (in terms of length, cross section diameter, and strength dependent on user requirements) and slid over two flexible cylinder embodiments (8) until one end is butted up against the end of the said rear segment (4). The preferred embodiment contains springs with outer diameters and inner diameters similar to that of the inner and outer diameter of the material chosen for the front segment (3) embodiment. To finish the joint between said rear segment (4) and said front segment (3) the two front stud cylinders (10F) slide into the two ends of the front segment (3) and secured by two said knurled bolts (16). After knurled bolts (16) are tightened it should be noted that ends of joint springs (14) are pressing against ends of said rear segment (4) and ends of said front segment (3). Changing of joint springs (14) or other such maintaince, if desired, is accomplished by reversing the process described in this paragraph.

In the preferred embodiment, Teflon (PTFE) is coated onto the inner surface of locking sleeves (5) and/or onto the outer surface of ends of said front segment (3) and said rear segment (4). This additional step should allow easier locking action of locking sleeves (5L and 5R) and retard water from freezing between said surfaces.

OPERATION OF INVENTION

There are several practical uses of the present invention. The pivotal action in the rear of the snowshoe frame allows the user to "step" down hills with significant inclination, rather than slide down toe first. The pivotal action also allows a more natural heel first stride across flat hardpacked snowfields. Since most cases of snowshoeing will require the traditional flat rigid frame, the present invention allows the user to lock the flexible rear section into this position.

When a conventional snowshoe frame (50) is used on an medium to hard packed snow incline of angle ($\phi$), the user is forced to point the toe of his/her foot down the incline. The elongated rear section causes this by reducing the pressure exerted onto the surface of the snow, thus decreasing the amount of displaced snow. The major axis of the snowshoe is forced to align with the surface of the incline. For this situation the traction, or frictional forces, the user has for maintaining position is a function of surface coefficient of static friction ($\mu_s$), the angle of the incline ($\phi$), and the weight of the user (21). The equation for the frictional forces is expressed as:

rule: Normal force (26)=Weight (21) * COS ($\phi$)

rule: Frictional force (23)=Normal force (26) * Coefficient of Static Friction ($\mu_2$)

which implies: (23)=(21) * ($\mu_s$) * COS ($\phi$)

To determine weather a user will slide or not, generally, the Frictional force (23) is subtracted from the sliding force (22), where sliding force (22) is defined as:

Sliding force (22)=Weight (21) * SIN ($\phi$)

If your answer is positive the user will slide, if it is zero or negative the user is stable. In this sanerio the question of user stability is dependant on ($\mu_s$), ($\phi$), and (21).

For the present invention of a snowshoe frame (1), the physics change. Joints (7R and 7L), comprised of Flexible cylinders (8R and 8L) and springs (14), allow flexing about an axis (9) which is colinear to the two ends of front segment (3). Since rear segment (4) can flex, or rotate upwardly about said axis (9), the user and exert a substantially larger pressure onto the surface of the snow, because all pressure on rear segment (4) is negated by said motion. This allows the user to compress the snow below his/her heel to form a "step", whereas the snow compressed below the heel forms a plane in the snow near to horizontal. In this scenario, the centroid of forces (20') is located along the horizontal step plane causing the applied value of incline ($\phi$) to be near zero, thus the Sliding force (22') is also zero. In this case, the user is always stable independent of frictional forces (23'). The embodiment of snowshoe frame (1) is an improvement over old art by giving the user substantially better stability while traversing down inclines of medium to hard packed snow.

Figure 4A:
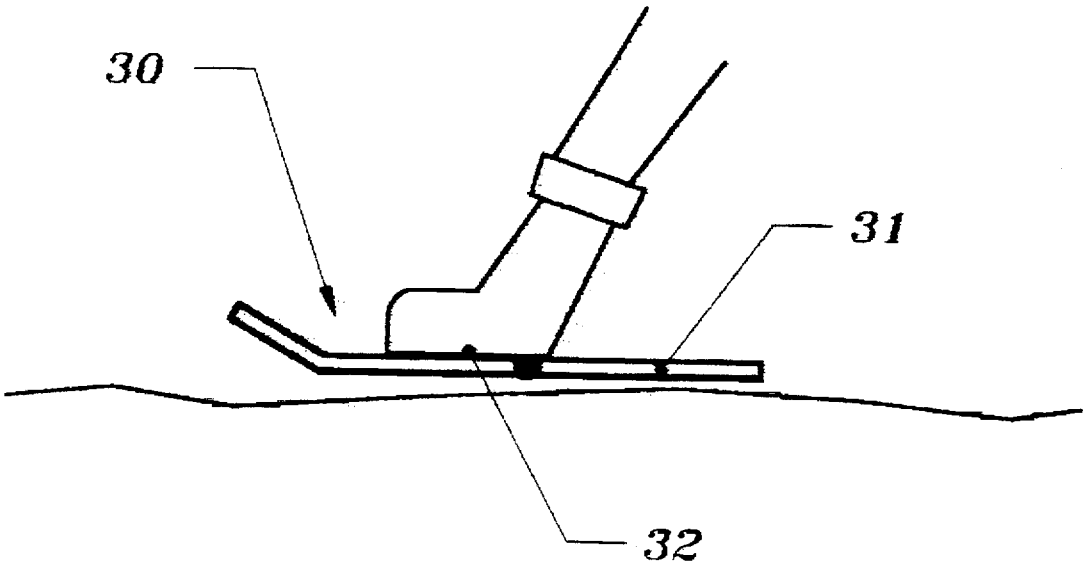
FIG. 4A (PRIOR ART)
FIG. 4A is a free body diagram of prior art on a flat surface.
Figure 4B:
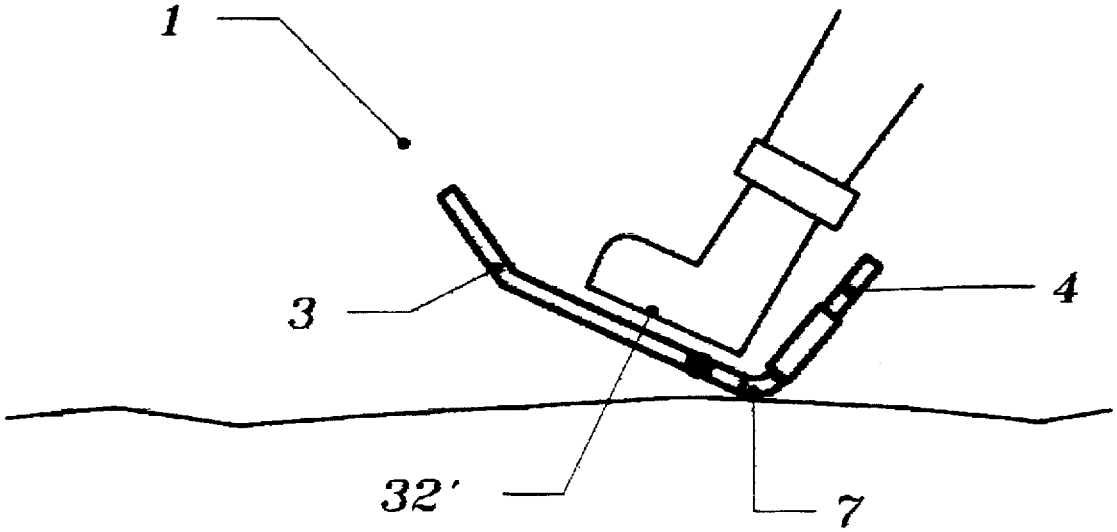
FIG. 4B is a free body diagram demonstrating the stability of the snowshoe frame on a flat surface, according to the present invention.

The described flexing occurring along axis (9) also allows natural walking patterns across flat hard packed snowfields. In general, people walk with a rolling motion in which the heel hits the ground first then, as weight is shifted forward, the sole of the foot rolls into complete contact with the ground. FIG. 4A shows a step with conventional snowshoe (30). The sole of the users foot (32) must always be flat on the ground because long rear portion (31) of conventional snowshoe (30) does not allow the heel to hit first. FIG. 4B shows a step with the present invention (1). The said motion about axis (9) allows the heel to hit the ground first similar to a natural walking pattern. The embodiment of snowshoe frame (1) is and improvement over old are by allowing natural walking patterns on flat, hard packed snow.

In many cases of snowshoeing, the user will desire to use the entire surface area of the snowshoe to keep themselves on top of the snow. For instance, if the rear section (4) was allowed to flex as described in snowfields of powdery consistency the user would sink into the snow almost as if he/she did not have a snowshoe on. In this case the user can lock joints (7) by engaging locking sleeves (5R and 5L) into primary position (5R' and 5L') in which snowshoe frame embodiment (1) acts as a rigid frame. In the preferred embodiment locking sleeves (5R and 5L) are held in the primary and secondary position by the frictional forces between locking sleeves (5R and 5L) and outer diameters of front segment (3) and rear segment (4). An alternative embodiment could use cotter pins, spring loaded ball bearings, frictional cam devices, and other such mechanisms commonly used to lock sleeves onto shafts.

Quite often a snowshoeist encounters a wide range of snow types on a single hike. It is important that the operation between said primary position (5R' and 5L') and secondary position (5R and 5L) does not require much work. Knurling of outer diameter of locking sleeves (5) in the preferred embodiment of snowshoe frame (1) helps the user manipulate locking sleeves (5) into position. Icing occurring between said front (3) and rear (4) segments and locking sleeves (5) is also an important issue to consider. The Teflon coating in the preferred embodiment may retard water crystallization.

CONCLUSION, RAMIFICATIONS, AND SCOPE OF INVENTION

The presented snowshoe frame (1) invention has several benefits over conventional snowshoe frames and is fairly simple to construct as described above, but the detailed description contains specifications for one example of a preferred embodiment. Many other variations are possible. For example, the flexible cylinder (8R and 8L) could be attached to front (3) and rear (4) segments by crimping a sleeve around both ends of flexible cylinder (8). Also, adhesives which could form a bond between the material of front segment (3) and the material of flexible cylinder (8). In another embodiment the spring damper characteristics of the said rear section (4) would be achieved by an elastic strap passing through the axis of rotation (9) through the center of the major snowshoe axis (2) and attached to both said segments. The elastic strap is made from bungee cord or other such materials.

What is claimed and desired to be secured by United States Letters Patent is:

1. A snow shoe frame comprising:

an elongated generally U-shaped front section having right and left side bars wherein said bars are hollow;

a generally U-shaped rear section having right and left side bars wherein said bars are hollow;

two flexible joints joining the right side bars together and the left side bars together, said joints each comprising a flexible cylinder and spring which allow the rear section to flex upwardly with respect to the front section, said flexible cylinder extends inside the ends of the hollow bars and the spring is positioned over the cylinder wherein one end of the spring butts up against the end of the bar of the rear section;

two cylindrical locking sleeves that slide over the ends of the bars between a primary position and a secondary position, said primary position locks the joints to prevent flexing between the front and rear sections to provide a rigid frame and said secondary position allows the rear section to flex.

* * * * *